United States Patent [19]

Lee

[11] Patent Number: 4,552,268

[45] Date of Patent: Nov. 12, 1985

[54] LIGHT-TIGHT CARTON FOR X-RAY AND OTHER LIGHT SENSITIVE FILM

[75] Inventor: John F. Lee, Vernon, N.J.

[73] Assignee: Federal Paper Board Co., Inc., Montvale, N.J.

[21] Appl. No.: 572,298

[22] Filed: Jan. 20, 1984

[51] Int. Cl.[4] ..... B65D 85/67

[52] U.S. Cl. ..... 206/455; 40/312; 206/459; 206/624; 229/44 R; 229/45 R

[58] Field of Search ..... 40/312, 359; 206/449, 206/454, 455, 459, 534, 604, 620–624, 627–630, 631, 634; 229/9, 19, 33, 44 CB, 44 R, 45 R; 354/181–184, 275–285

[56] References Cited

U.S. PATENT DOCUMENTS

| | | | |
|---|---|---|---|
| 938,981 | 11/1909 | Cornell | 206/459 |
| 2,274,278 | 2/1942 | Sanders | 206/455 |
| 2,361,659 | 10/1944 | Smith | 229/44 R |
| 3,078,030 | 2/1963 | Gorton | 229/44 CB |
| 3,261,537 | 7/1966 | Kistner | 229/45 |
| 3,642,194 | 2/1972 | Scully | 229/45 |
| 3,910,483 | 10/1975 | Ritter | 229/43 |
| 3,912,078 | 10/1975 | Asano | 206/455 |
| 4,257,317 | 3/1981 | Yoshida et al. | 206/455 |
| 4,413,734 | 11/1983 | Newcombe, Jr. | 206/455 |

FOREIGN PATENT DOCUMENTS

| | | | |
|---|---|---|---|
| 1224991 | 2/1960 | France | 206/459 |
| 1319569 | 1/1963 | France | 206/455 |
| 2293368 | 7/1976 | France | 229/44 CB |
| 0357242 | 3/1938 | Italy | 354/277 |
| 0575104 | 2/1946 | United Kingdom | 206/455 |

OTHER PUBLICATIONS

"Modern Fruit Packing", Fruit and Produce Packing Inc., Indianapolis, Ind., 1940, 1 page.

*Primary Examiner*—George E. Lowrance
*Assistant Examiner*—Jimmy G. Foster
*Attorney, Agent, or Firm*—Charles E. Brown

[57] ABSTRACT

This relates to a flip top box type carton wherein there is a top portion which is rupturable relative to the remainder of the carton so as to permit the top end of the carton to open. The carton, however, is so constructed wherein when reclosed, it is light-tight. The carton is particularly adapted to have received therein an inner carton in which a film package is placed. The carton is of a construction wherein it may be erected in situ around the inner carton containing the film pack. The sides of the carton are so constructed at the lines of rupture therealong wherein inner side panels have projecting portions which both facilitate the reclosing of the carton without hang up of the top portion and also to make the corners light-tight. Although conventional locking tabs and locking apertures are provided, the front panel of the outer carton is white while other portions of the outer carton are darkly colored so that when the carton is fully open a top part of the front panel is readily visible in a darkroom and when the top portion is returned to its carton closing position and is locked in place, there are two separate white panels which indicate proper engagement of the locking tabs in their respective apertures.

15 Claims, 7 Drawing Figures

LIGHT-TIGHT CARTON FOR X-RAY AND OTHER LIGHT SENSITIVE FILM

This invention relates in general to new and useful improvements in flip top cartons, and more particularly to a flip top carton which has a light safe feature and is usable in the storage and dispensing of x-ray film and the like.

Most particularly, this invention relates to a carton which may be readily formed around an inner carton in which the x-ray film and the like have already been placed.

One feature of the invention is the construction of the side and top end portion of the carton wherein each side includes an inner panel and an outer panel and a top panel of the carton is provided with securing flaps. Only the outer side flaps are provided with weakening lines and are ruptured in the opening of the carton. The inner side panels extend upwardly beyond the line of rupture of the outer side panels and serve, together with the inner carton, to maintain light tight seals along the sides of the carton after it has been opened.

In a like manner, the carton is provided with a closure flap which overlies the line of separation of a top portion of the front panel from the remainder of the front panel.

Not only does the upper portion of the inner side panel function to provide a light shield, it also assures that the top may be folded back to its carton forming position without wedging.

The invention particularly utilizes a special gluing sequence on the side panels and the flaps carried by the top panel whereby the inner side panels are folded to vertical positions, then the flaps of the top panel are folded into overlapping relation with top portions of the inner side panels, after which the outer side panels are folded down and are adhesively secured to both the inner side panels and the top flaps. This gluing sequence can be automatically effected.

Another feature of the invention is a safety lock arrangement which includes primary and secondary locking tabs engageable in apertures in the front panel. These tabs are carried by the closure panel. Portions of the front panel adjacent the apertures are left unprinted or white so as to instantly alert one to whether the package is open or closed.

With the above and other objects in view that will hereinafter appear, the nature of the invention will be more clearly understood by reference to the following detailed description, the appended claims, and the several views illustrated in the accompanying drawings.

Figures 1, 3, 5, 7:
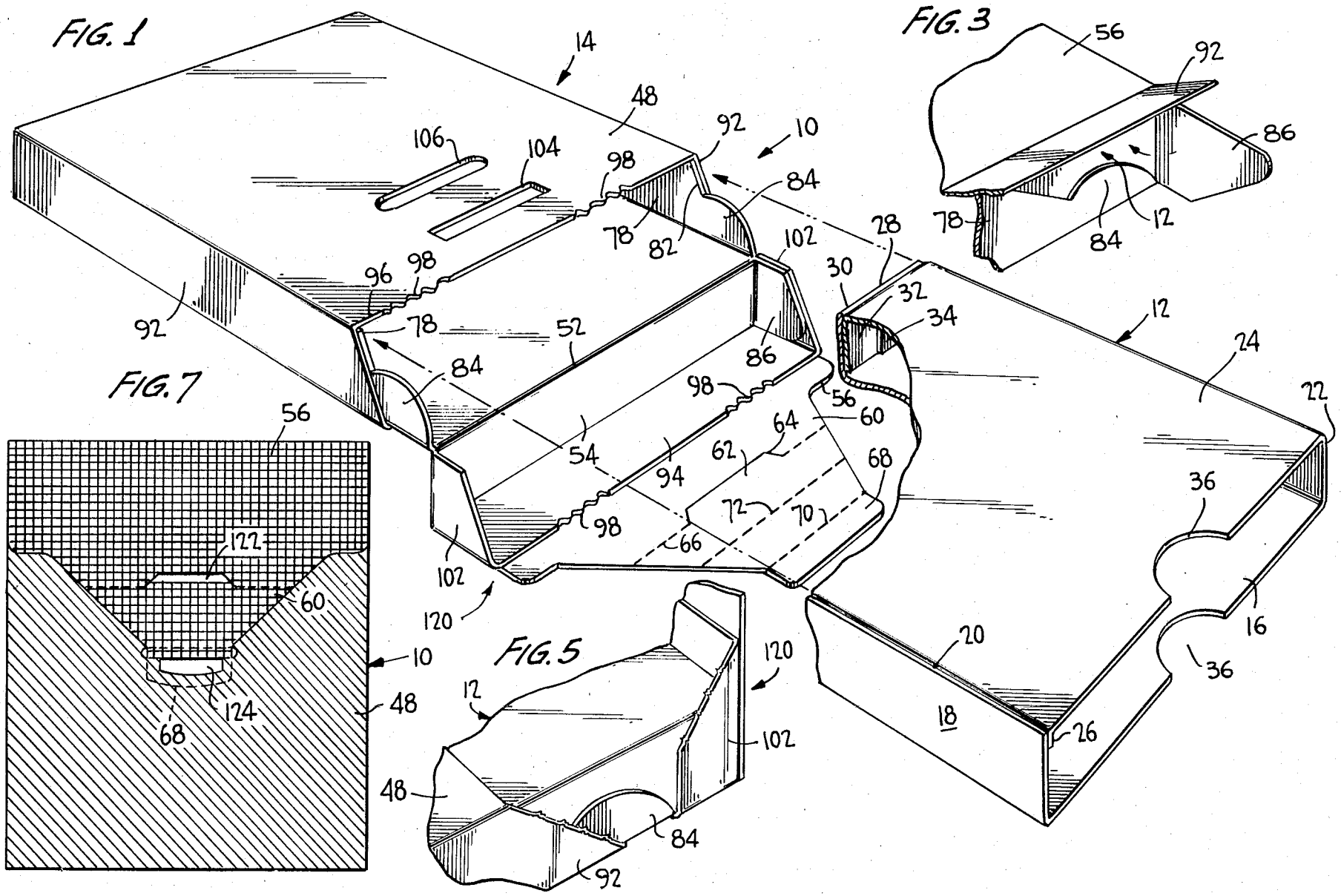
FIG. 1 is an exploded perspective view showing the carton in its opened state with the inner carton removed therefrom and portions thereof broken away and shown in section.
FIG. 3 is a fragmentary perspective view showing the sequence of folding of the blank to form the completed outer carton.
FIG. 5 is a fragmentary perspective view showing the carton in the process of being closed.
FIG. 7 is a plan view on a reduced scale showing the opened carton in its reclosed state with unprinted areas of the front panel indicating proper closure of the carton.

Referring now to the drawings in detail, it will be seen that there is illustrated the carton which is the subject of this invention, the carton being generally identified by the numeral 10. The carton 10 includes an inner carton 12 and an outer carton 14.

It is to be understood that a film pack (not shown) is to be packaged within the inner carton 12. If desired, the inner carton 12 may be formed in situ around the film pack.

The inner carton 12 includes a bottom panel 16 which is provided along one edge thereof with a side panel 18 having a free edge 20. Along the other edge of the bottom panel 16 is a second side panel 22 which has connected thereto one edge of a front panel 24. The front panel 24 carries along the opposite edge thereof a side panel or flap 26. The side panels 18, 26 are in overlapped bonded relation.

The carton 12 also includes a bottom 28 which an outer bottom panel 30 carried by the rear panel 16 and an inner bottom panel 32 carried by the front panel. The panels 30, 32 are bonded together. Further, the side panels 18, 22 are provided at their lower ends with bottom flaps 34 which are bonded to the bottom panel 32.

It will be readily apparent that the film pack may be deposited on the rear panel 16 and the blank from which the carton 12 is formed may then be automatically folded around the film pack and the various panels and flaps thereof bonded together.

It is also to be noted that the carton 12 has an opened top and the upper parts of the front and rear panels 24, 26 may be provided with notches 36 to facilitate the removal of the film pack.

At this time, it is pointed out that the carton 12 is preferably formed of a stock which is of a dead black color so as to light proof. It is also preferable that the stock be nonbendable and in order to fold the various panels and flaps of the carton 12, special fold lines must be formed in the blank. In a typical construction, the carton 10 is intended to have packaged therein film weighing from five to fifteen pounds and the inner carton 12 will be formed from a blank which is formed of news or chipboard having a thickness up to 50 points.

Figure 2:
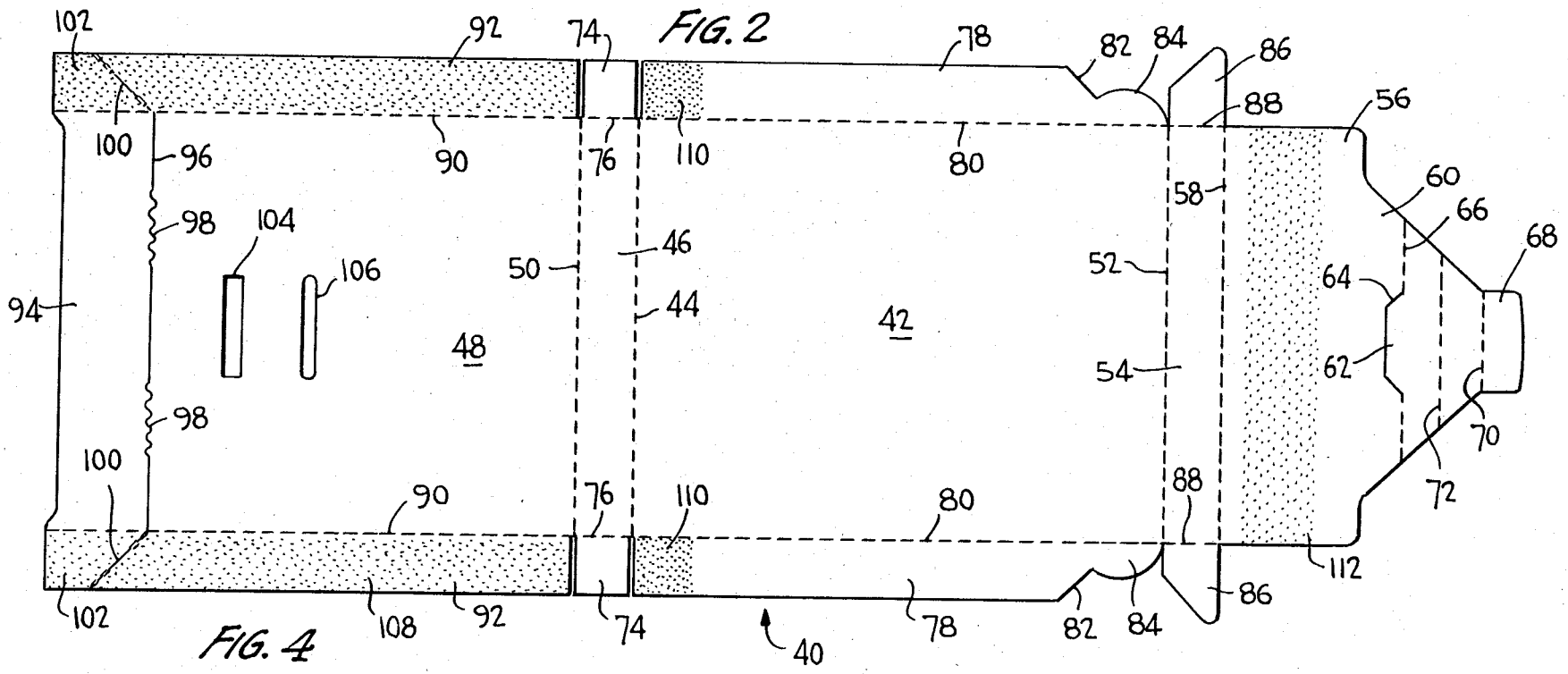
FIG. 2 is a plan view of the blank from which the outer carton of FIG. 1 is formed.
Figure 6:
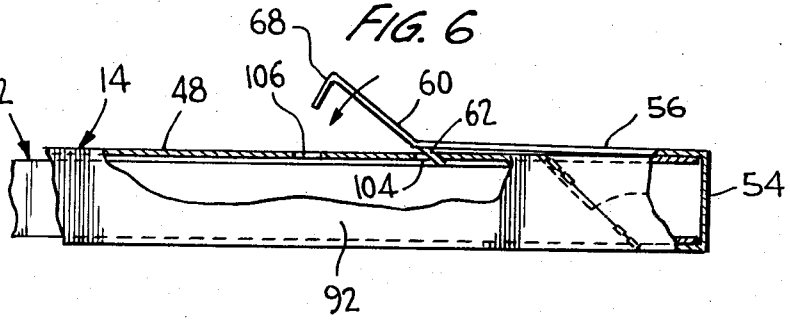
FIG. 6 is a fragmentary side elevational view, with parts being broken away, showing the locking sequence of the carton.
Figure 4:
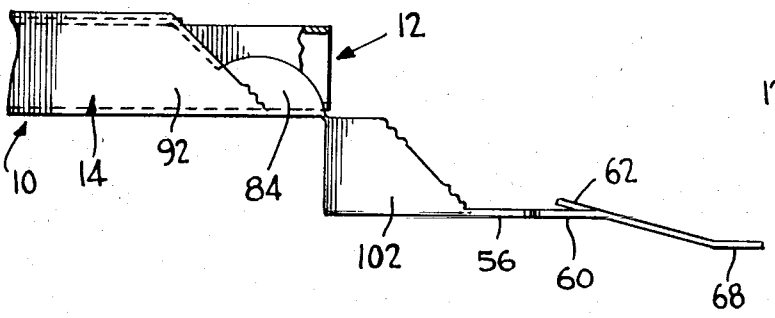
FIG. 4 is a side elevational view with parts broken away showing the opened carton.

The outer carton 14 is formed from a blank generally identified by the numeral 40 and illustrated in FIG. 2. The blank 40 is elongated and generally rectangular and includes a generally centrally located rear panel 42 which is connected along a fold line 44 to a bottom panel 46. In turn a front panel 48 is connected to the bottom panel 36 along a fold line 50.

At the opposite end of the rear panel 42 there is connected along a fold line 52 a top panel 54. The top panel 54, in turn, carries a closure panel 56 along a fold line 58. The closure panel 56 has formed as a continuation thereof a locking flap 60 which is provided with a primary locking tab 62 formed by way of a generally C-shaped cut 64 along a fold line 66. There is also a terminal secondary locking tab 68 which is connected to the locking flap along a fold line 70. The locking flap 60 is also provided with a transverse fold line 72 intermediate the fold lines 66, 70.

At this time, it is pointed out that in order to form the bottom of the carton 14, the bottom panel 46 is provided with a pair of flaps 74 connected to opposite ends thereof along fold lines 76.

The rear panel 42 has connected along opposite sides thereof inner side panels 78, the inner side panels being connected to the rear panel 42 along fold lines 80.

It is to be noted that the inner side panels 78, at the upper ends thereof, have a portion of the material removed so as to define diagonal intermediate ends 82 which are disposed adjacent terminal rounded end portions 84.

It is also to be noted that the top panel 54 is provided with closure forming flaps 86 which are connected to the top panel 54 along fold lines 88.

Finally, it is to be noted that the front panel 48 has connected along fold lines 90 at opposite sides thereof outer side panels 92.

The front panel 48 has a top portion 94 thereof by transversely extending interrupted cut line, the interrupting portions being in the form of weakened line portions 98. At the ends of the cut line 96 are diagonal combination cut and weakening lines 100 which extend across the side panels 92 and define top side portions 102.

Finally, the front panel 48 is provided with locking apertures 104, 106 for receiving the primary locking tab 62 and the secondary locking tab 68 respectively.

In order that the various panels of the outer carton 14 may be automatically bonded together, adhesive 108 is applied entirely over the inner surface of the outer side panels 92. Adhesive is also applied over the inner surface of the inner flaps 78 which are to be overlapped by the flaps 74, this adhesive being identified by the numeral 110. Finally, a wide adhesive stripe 112 is applied against the inner surface of the closure flap 56.

At this time it is pointed out that the blank 40 for the outer carton 14 will be formed from 28–35 point craftboard. Further, the interior surface will be black so as to be light proof. It is also desired that the outer surface of the blank 40 be primarily of a dark color. However, that part of the front panel 48 above the aperture 104 and below the aperture 106 which would be normally covered by the tabs 62, 68, if the tabs are not directed into their respective apertures, will be preferably white. In addition, substantially all of the front panel which will covered by the closure panel 56 and the closure flap 60 may also be white. The purpose of the white areas will be described in more detail hereinafter.

When erecting the carton 14 it is preferred that the inner carton 14, with the film pack loaded therein, be seated on the rear panel 42 in alignment therewith. The blank 40 is then folded along the fold lines 44, 50 to bring the bottom panel 46 against the bottom 28 of the carton 12 and the top panel 48 into overlying relation to the carton 12. The flaps 74 may be folded along side the sides of the carton 12 at an appropriate time, and the blank 40 will be folded along the fold lines 52 and 58 to bring the top panel 54 against the open end of the carton 12 and the closure flap 56 into overlying relation to the upper portion of the front panel 48 with the tabs 62 and 68 being engaged in the apertures 104, 106. At this time the closure flap 56 will be bonded to the top portion 94 of the front panel 48 by way of the adhesive 112.

Next, as is best shown in FIG. 3, the inner side panels 78 will be folded up along the sides of the carton 12 and will be bonded to the flaps 74 by means of adhesive 110. Following this, the flaps 86 will be folded down over the inner side panels 78 in overlapping relation. Finally, the outer side panels 92 will be folded down over the side panels 78 and the flaps 86 and bonded thereto by means of adhesive 108 to complete the package.

When it is desired to open the carton 10, the closure flap 56 and the locking flap 60 will be engaged generally at their intersections while pressing down on the front panel 48. This action will cause rupture of the already partially separated front panel 48 along the weakened lines 98 so as to release the upper part of the outer carton 14. A further lifting action will result in the rupture of the outer side panels 92 along the combined cut and weakened lines 100. The net result is that a rigid top portion of the carton 14, generally identified by the numeral 120, will be free to hinge along the fold line 52 so as to open the carton 10. Access will now be available to the film pack through the opened end of the inner carton 12.

When the required film has been removed from the carton, the top portion 120 is hinged back to its closed position. During this closing action, the top portions 84 of the inner side panels 78 will serve initially to guide the released top side portions 102 and the flaps 86 secured thereto back over the inner side panels 78 and the carton 12 without bind. Further, the portions 84 will also serve to make the corner light-proof after reclosure. It is also to be noted that the inner carton 12 also serves to make the junctures between the top portion 120 and the remainder of the carton 14 light-tight.

Referring now to FIG. 7, it will be seen that due to the coloring of the outer surface of the closure panel 56 and locking flap 60, as well as a coloring of a major portion of the front panel 46, the white areas above and below the apertures 104, 106, respectively, will readily appear to a technician within a darkroom. These areas are specifically identified in FIG. 7 by the reference numerals 122 and 124. This gives evidence of the fact that the carton 14 has been closed and locked.

It is also to be understood that by making the upper portion of the front panel 48 white, it will be readily observable by a technician within a darkroom that the top portion 120 has not been folded to its carton closing position.

Although only a preferred embodiment of the invention has been specifically illustrated and described herein, it is to be understood that minor variations may be made in the cartons without departing from the spirit and scope of the invention, as defined by the appended claims.

What is claimed is:

1. A reclosable carton unit for film and like light sensitive materials, said carton unit comprising inner and outer cartons formed of light proof paperboard, said outer carton comprising front and rear panels joined together by sides, a bottom panel and a top panel, said top panel being hingedly carried by said rear panel, said front panel having a top portion and a remainder, said top portion being connected to the remainder along a rupturable transverse weakening line spaced from said top panel, a closure panel carried by said top panel and overlying an upper part of said front panel including said top portion, said side walls having weakening lines extending from ends of said front panel weakening line and defining top side portions, said top portion being fixedly secured to said closure panel, said inner carton extending across and beyond all of said weakening lines whereby when said outer carton is opened and reclosed, said inner carton extends across and forms a light barrier across parting lines defined by rupture of said front panel and said sides along said weakening lines, and locking tabs carried by said closure panel for locking engagement with said front panel below said weakening line thereof.

2. A reclosable carton unit according to claim 1 wherein said top side portions are carried by said top portion, and said top panel has flaps fixedly secured to said top side portions to define a rigid closure unit.

3. A reclosable carton unit according to claim 2 wherein each of said sides includes an inner side panel and an outer side panel disposed in overlapped fixedly secured relation, said side wall weakening lines being formed only in said outer side panels, and said inner and outer side panels above said side wall weakening lines with said inner side panels freely extending beyond said outer side panels in the open state of said outer carton.

4. A reclosable carton unit according to claim 1 wherein each of said sides includes an inner side panel and an outer side panel disposed in overlapped fixedly secured relation, said side wall weakening lines being formed only in said outer side panels, and said inner and outer side panels above said side wall weakening lines with said inner side panels freely extending beyond said outer side panels in the open state of said outer carton.

5. A reclosable carton unit according to claim 4 wherein said inner side panels above said side weakening lines form guides for reintroducing said inner carton into said outer carton.

6. A reclosable carton unit according to claim 4 wherein said inner side panels above said side weakening lines form guides for reintroducing said inner carton into said outer carton, said guide being of a width less than the width of the remainder of said inner side panel and being rounded.

7. A reclosable carton unit according to claim 1 wherein said inner carton has an open top end, said inner carton is of a size and shape to substantially fill said outer carton, and said top panel closes said inner carton open top end.

8. A reclosable carton unit according to claim 1 wherein said closure panel carries a closure flap hingedly connected to said closure panel, said closure flap having at a free end thereof a secondary one of said locking tabs facing away from said closure panel, and there being a primary one of said locking tabs carried by said closure flap and formed from said closure panel, and there being locking apertures in said front panel for receiving said locking tabs.

9. A reclosable carton unit according to claim 8 wherein a portion of said front panel above said locking aperture for said primary locking tab is colored differently from said closure panel, and a portion of said front panel below the other of said locking apertures being colored differently from said closure panel whereby failure of either or both of said locking tabs to engage in a respective locking aperture will be automatically visually identified.

10. A reclosable carton unit according to claim 9 wherein said closure panel and said front panel with the exception of said front panel portions adjacent said apertures are darkly colored, and said portions of said front panel adjacent said locking apertures being lightly colored so as to be visible in a darkroom.

11. A reclosable carton unit according to claim 1 wherein each of said cartons is formed of a single blank and has a sealed bottom.

12. A reclosable carton unit according to claim 1 wherein at least said inner carton is formed of a non-bending board.

13. A reclosable carton unit according to claim 1 wherein at least said inner carton is formed of a non-bending board with said inner carton having a thickness up to 50 points and said outer carton is formed of 28 to 35 point kraft.

14. A carton to be reclosed in a darkroom and the like, said carton including a front panel and a closure panel for overlying said front panel, said closure panel has hingedly connected thereto a locking flap with locking tabs, said locking flap having at a free end thereof a secondary one of said locking tabs facing away from said closure panel, and there being a primary one of said locking tabs carried by said locking flap and formed from said closure panel, and there being locking apertures in said front panel for receiving said locking tabs, a portion of said front panel closely adjacent and above said locking aperture for said primary locking tab being colored differently from said closure panel, and a portion of said front panel closely adjacent and below the other of said locking apertures being colored differently from said closure panel whereby failure of either or both of said locking tabs to engage in a respective locking aperture will be automatically visually identified.

15. A reclosable carton unit according to claim 14 wherein said closure panel and said front panel with the exception of said front panel portions closely adjacent said locking apertures are darkly colored, and said portions of said front panel closely adjacent said locking apertures being lightly colored so as to be visible in a darkroom.

* * * * *